US011776728B2

(12) United States Patent
Yoshida

(10) Patent No.: US 11,776,728 B2
(45) Date of Patent: Oct. 3, 2023

(54) REACTOR WITH COVER

(71) Applicant: Fanuc Corporation, Yamanashi (JP)

(72) Inventor: Tomokazu Yoshida, Yamanashi (JP)

(73) Assignee: Fanuc Corporation, Yamanashi (JP)

( * ) Notice: Subject to any disclaimer, the term of this patent is extended or adjusted under 35 U.S.C. 154(b) by 473 days.

(21) Appl. No.: 16/923,538

(22) Filed: Jul. 8, 2020

(65) Prior Publication Data

US 2021/0098170 A1 Apr. 1, 2021

(30) Foreign Application Priority Data

Sep. 26, 2019 (JP) ..... 2019-175752

(51) Int. Cl.
*H01F 27/02* (2006.01)
*H01F 27/28* (2006.01)
*H01F 27/24* (2006.01)

(52) U.S. Cl.
CPC ..... *H01F 27/02* (2013.01); *H01F 27/24* (2013.01); *H01F 27/28* (2013.01)

(58) Field of Classification Search
CPC ..... H01F 27/02; H01F 27/24; H01F 27/28; H01F 3/14; H01F 5/04; H01F 27/29; H01F 37/00; H01F 27/266
See application file for complete search history.

(56) References Cited

U.S. PATENT DOCUMENTS 3,516,040 A * 6/1970 Ripley ..... H01F 27/402 336/107
3,710,002 A * 1/1973 Link ..... H01F 27/02 336/59
5,116,246 A * 5/1992 Perry ..... H01R 9/245 337/209
10,586,644 B2 3/2020 Tsukada et al.
2006/0279393 A1* 12/2006 Shudarek ..... H01F 37/00 336/198
2008/0197961 A1* 8/2008 Patel ..... H01F 21/12 336/170
2009/0115551 A1* 5/2009 Kobayashi ..... H01F 17/045 336/92
2009/0243769 A1* 10/2009 Takaya ..... H01H 50/045 335/127
2010/0079230 A1* 4/2010 Brubaker ..... H01F 41/005 29/605

(Continued)

FOREIGN PATENT DOCUMENTS

JP 59145080 U 9/1984
JP 61097884 U 6/1986

(Continued)

*Primary Examiner* — Mang Tin Bik Lian
*Assistant Examiner* — Mangtin Lian
(74) *Attorney, Agent, or Firm* — RatnerPrestia

(57) ABSTRACT

A reactor includes an outer peripheral iron core, at least three iron cores, and a coil wound around the iron core. The reactor further includes an energizing portion connected to the coil and configured to be connected to a cable, and a cover provided to cover the energizing portion. At least one cutout formed in the cover is provided with at least one adjustment member configured to adjust an area of the cutout at least partially in the cover. The adjustment member is configured to be cut away from the cutout or to be bent with respect to a surface where the cutout is formed.

6 Claims, 10 Drawing Sheets

(56) References Cited

U.S. PATENT DOCUMENTS

| | | | | |
|---|---|---|---|---|
| 2014/0091891 | A1* | 4/2014 | Metzler | H01F 27/29<br>336/192 |
| 2017/0084377 | A1* | 3/2017 | Maeda | H01F 27/245 |

FOREIGN PATENT DOCUMENTS

| | | | |
|---|---|---|---|
| JP | 63016488 | U | 2/1988 |
| JP | 2018147982 | A | 9/2018 |
| JP | 2019029443 | A | 2/2019 |

* cited by examiner

REACTOR WITH COVER

CROSS-REFERENCE TO RELATED APPLICATIONS

This application is a new U.S. Patent Application that claims benefit of Japanese Patent Application No. 2019-175752, filed Sep. 26, 2019, the disclosure of which application is incorporated herein by reference in its entirety for all purposes.

BACKGROUND OF THE INVENTION

1. Field of the Invention

The present invention relates to a reactor with a cover.

2. Description of the Related Art

Typically, a core body includes an outer peripheral iron core, and a plurality of iron cores that are disposed inside the outer peripheral iron core and around which coils are wound. In addition, a reactor mainly includes such a core body, an energizing portion connected to coils and configured to be connected to a cable, and a cover that is for preventing electric shock and that is attached to the energizing portion. Each of a plurality of terminals included in the energizing portion is connected to a lead extending from the coil.

In a reactor, a cross-sectional area of a cable that is used may be specified depending on a standard to which the cable conforms (e.g., whether the cable conforms to the North American standard: NFPA). When this North American standard: NFPA is given as an example, a cross-sectional area of a cable that conforms to the same standard increases compared to that of a cable that does not conform to the same standard.

When a cable having a large cross-sectional area is used, there is little clearance between the cover and the cable, so an operator does not contact the terminal of the energizing portion of the reactor or the like. However, when a cable having a small cross-sectional area is used, there is a problem in which the finger or the like of the operator enters a clearance between the cover and the cable and comes into contact with the terminal or the like of the energizing portion.

JP 2019-29443 A discloses that a cover for protection from electric shock is provided with a shrinkable member that fills the above-described clearance. Because such a shrinkable member exists, regardless of a diameter of the cable to be connected to the energizing portion, it is possible to prevent the operator from contacting the terminal or the like of the energizing portion.

SUMMARY OF THE INVENTION

However, when the operator presses the shrinkable member in JP 2019-29443 A, the shrinkable member easily deforms, so the operator may contact the terminal of the energizing portion and may be exposed to risk.

Therefore, it is desirable to provide a reactor that can prevent an operator from easily contacting a terminal or the like of an energizing portion regardless of a diameter of a cable to be connected to the energizing portion.

According to a first aspect of the present disclosure, a reactor is provided that includes a core body, the core body including an outer peripheral iron core, at least three iron cores disposed to contact an inner surface of the outer peripheral iron core or disposed to be coupled to the inner surface, and a coil wound around the iron core, wherein a gap capable of being magnetically coupled between one iron core among the at least three iron cores and another iron core adjacent to the one iron core is formed, and that further includes an energizing portion connected to the coils and configured to be connected to a cable, and a cover provided to cover the energizing portion, wherein at least one cutout formed in the cover is provided with at least one adjustment member configured to adjust an area of the cutout at least partially in the cutout, and the at least one adjustment member is configured to be cut away from the cutout or is configured to be bent with respect to a surface where the cutout is formed.

In the first aspect, by cutting away or bending the adjustment member according to a diameter of a cable to be connected, a clearance between the cable and an opening of the cover can be adjusted so as to be minimized while the cable is connected to the energizing portion. Therefore, regardless of the diameter of the cable to be connected to the energizing portion, it is possible to prevent an operator from easily contacting a terminal or the like of the energizing portion.

The objects, features and advantages of the present invention will become more apparent from the following description of embodiments in connection with the accompanying drawings.

DETAILED DESCRIPTION

Figure 1:
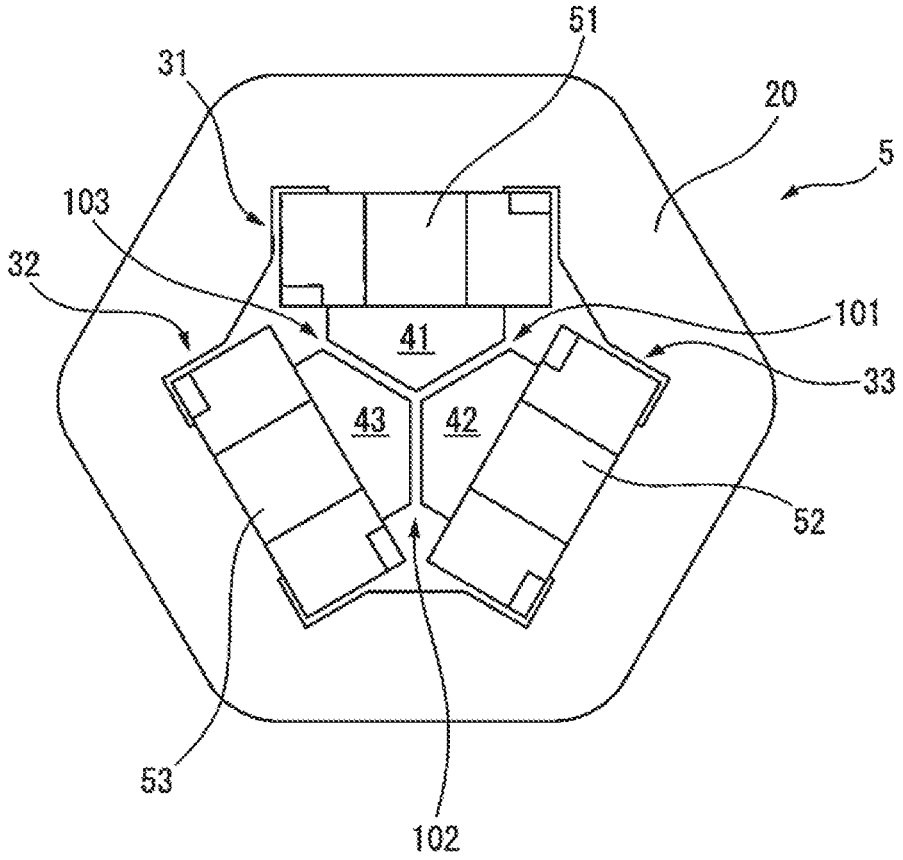
FIG. 1 is an end face view of a reactor according to a first embodiment.

Embodiments of the present invention will be described below with reference to the accompanying drawings. Throughout the drawings, corresponding components are denoted by common reference numerals. Scales in the drawings are changed as appropriate in order to facilitate understanding.

FIG. 1 is an end face view of a reactor according to a first embodiment. As illustrated in FIG. 1, a reactor 5 includes an outer peripheral iron core 20 having a hexagonal cross section and at least three iron core coils 31 to 33 disposed inward the outer peripheral iron core 20. In addition, the number of iron cores is preferably a multiple of three, and thus the reactor 5 can be used as a three-phase reactor. Note that the outer peripheral iron core 20 may have a polygon shape or a circular shape.

The iron core coils 31 to 33 respectively include iron cores 41 to 43 and coils 51 to 53 wound around the iron cores 41 to 43. The outer peripheral iron core 20 and the iron cores 41 to 43 are produced by stacking a plurality of magnetic sheets, for example, a steel sheet, a carbon steel sheet, and an electromagnetic steel sheet, or are produced from a dust core.

As can be seen in FIG. 1, the iron cores 41 to 43 are identical in size to one another, and are disposed at approximately equal intervals in a circumferential direction of the outer peripheral iron core 20. In FIG. 1, a radially outer end portion of each of the iron cores 41 to 43 contacts or is integrally formed with the outer peripheral iron core 20.

Moreover, a radially inner end portion of each of the iron cores 41 to 43 converges toward a center of the outer peripheral iron core 20 and has a tip angle of about 120 degrees. In addition, the radially inner end portions of the iron cores 41 to 44 are spaced apart from one another via gaps 101 to 103 capable of being magnetically coupled.

In other words, in the first embodiment, the radially inner end portion of the iron core 41 is spaced apart from the radially inner end portions of the respective two adjacent iron cores 42 and 43 via the gaps 101 and 103. The same applies to the other iron cores 42 to 43. Note that dimensions of the gaps 101 to 103 are ideally equal to one another, but may not be equal. In addition, in embodiments to be described later, designations such as the gaps 101 to 103 and designations such as the iron core coils 31 to 33 may be omitted.

In this way, in the first embodiment, the iron core coils 31 to 33 are disposed inside the outer peripheral iron core 20. In other words, the iron core coils 31 to 33 are surrounded by the outer peripheral iron core 20. This can reduce leakage of magnetic fluxes from the coils 51 to 53 to the outside of the outer peripheral iron core 20.

Figure 2A:
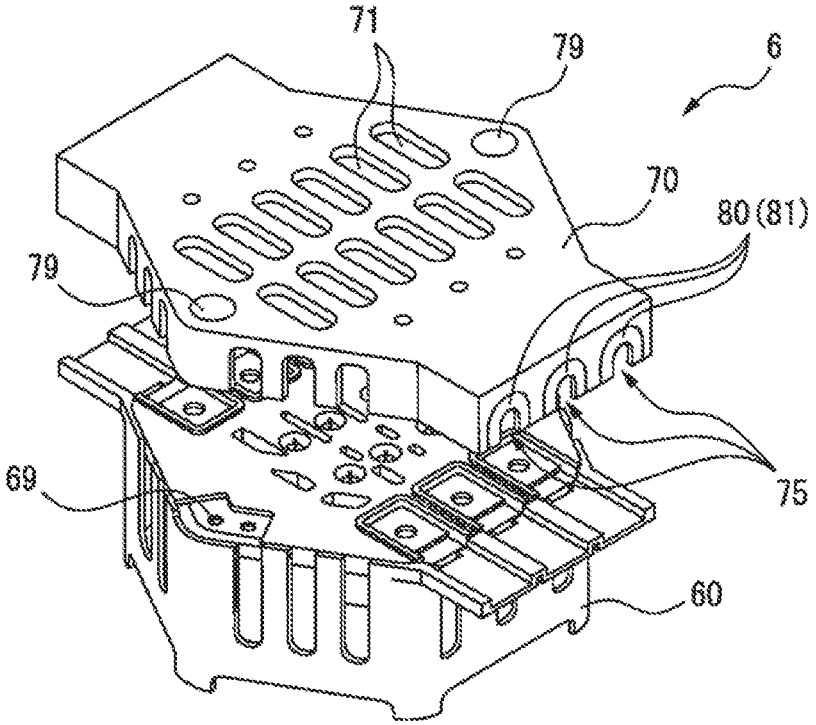
FIG. 2A is an exploded perspective view of the reactor illustrated in FIG. 1.
Figure 2A:
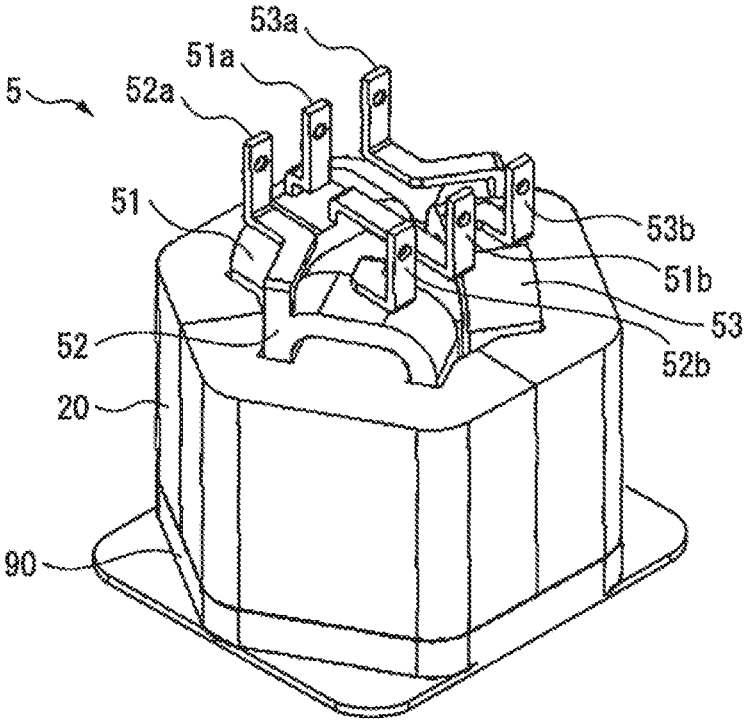
Figure 2B:
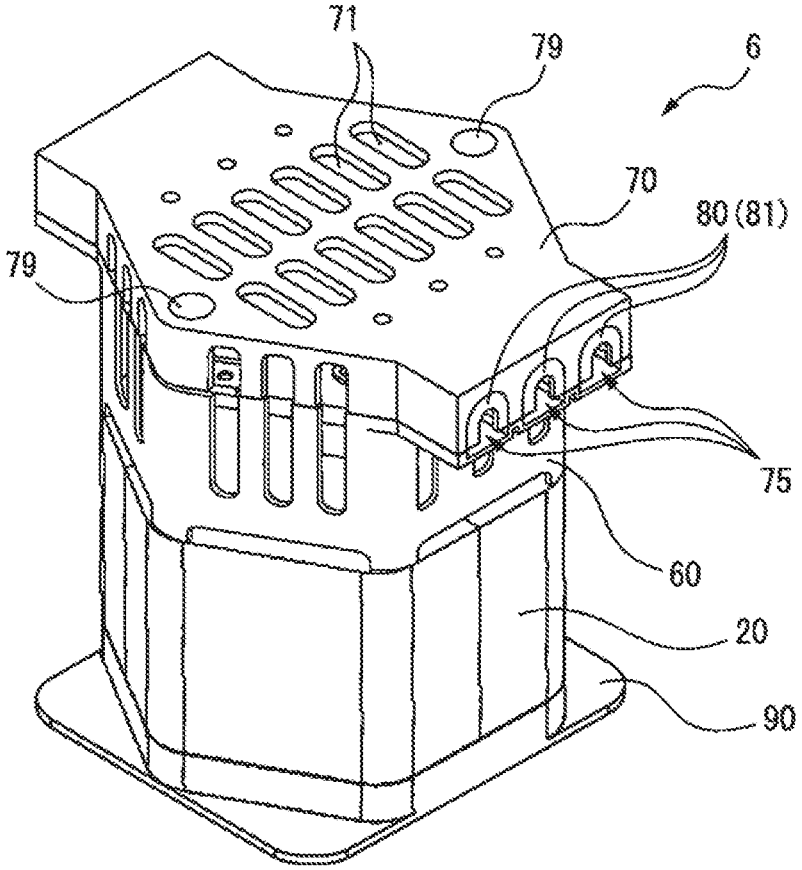
FIG. 2B is a perspective view of the reactor according to the first embodiment.

FIG. 2A is an exploded perspective view of the reactor illustrated in FIG. 1, and FIG. 2B is a perspective view of the reactor according to the first embodiment. As illustrated in these drawings, a mounting portion 90 with an end plate is mounted to a bottom end face of the outer peripheral iron core 20. The mounting portion 90 serves to mount the reactor 5 to a predetermined position. Note that the reactor 5 does not necessarily include the mounting portion 90.

In FIG. 2A, corresponding two leads among leads 51*a* to 53*a* and 51*b* to 53*b* extend from each of the coils 51 to 53. The leads 51*a* to 53*a* are on an input side and the leads 51*b* to 53*b* are on an output side. In addition, each of the leads 51*a* to 53*a* and 51*b* to 53*b* is individually curved, so that tips of the leads 51*a* to 53*a* and tips of the leads 51*b* to 53*b* are aligned in each single line. The tips of the leads 51*a* to 53*a* and 51*b* to 53*b* may be further curved for a purpose of connection to terminals to be described later.

An energizing portion 60 is illustrated above the outer peripheral iron core 20. The energizing portion 60 has an outer shape substantially corresponding to the outer peripheral iron core 20. A height of the energizing portion 60 in an axial direction is larger than those of protruding portions of the coils 51 to 53 from the outer peripheral iron core 20. The energizing portion 60 includes input side terminals connected to the leads 51*a* to 53*a* on the input side, and output side terminals connected to the leads 51*b* to 53*b* on the output side, on a top face thereof. These input side terminals and output side terminals are respectively connected to the leads 51*a* to 53*a* and the leads 51*b* to 53*b* of the coils 51 to 53. Furthermore, the energizing portion 60 is configured so as to be connected to a cable to be described later.

Furthermore, a cover 70 for preventing electric shock is illustrated above the energizing portion 60. The cover 70 is preferably formed of an insulator, for example, hard resin. The cover 70 according to the first embodiment has an outer shape substantially corresponding to the outer peripheral iron core 20. On a side surface of the cover 70, cutouts 75 are formed at positions corresponding to the input side terminals of the energizing portion 60 and positions corresponding to the output side terminals of the energizing portion 60.

Furthermore, at least one ventilation hole 71 is formed on a top face of the cover 70. When the coils 51 to 53 and the like generate heat, the ventilation hole 71 serves to dissipate the generated heat. The ventilation hole 71 preferably has an area in which the human finger does not enter in accordance with Protection Rating IP2 of the Japanese Industrial Standard. Alternatively, the ventilation hole 71 preferably has such an area that the human hand does not enter in accordance with Protection Rating IP1 of the Japanese Industrial Standard. Accordingly, the safety of an operator can be ensured.

Furthermore, the ventilation hole 71 may be a hole through which only a tool, especially only a probe of the tool, can enter. A tool, such as a tester, is passed through such a hole, and can contact the terminal and measure a voltage or the like.

The leads 51*a* to 53*a* of the coils 51 to 53 are connected to the input side terminals of the energizing portion 60, and the leads 51*b* to 53*b* are connected to the output side terminals of the energizing portion 60.

Additionally, the energizing portion 60 is attached to a top end face of the outer peripheral iron core 20 and is fixed with screws or a predetermined jig. Each of the input terminals and the output terminals are then connected to a cable to be described later.

The cover 70 is then disposed on a top end face of the energizing portion 60. As illustrated in FIG. 2A, holes 79 formed in the cover 70 correspond to holes 69 formed in the top end face of the energizing portion 60.

These holes 79 and 69 are screwed and engaged, so that the cover 70 is fixed to the energizing portion 60. Note that the energizing portion 60 may be fixed to the outer peripheral iron core 20 in the same manner. In this way, the reactor 5 illustrated in FIG. 2B can be obtained.

Figure 3A:
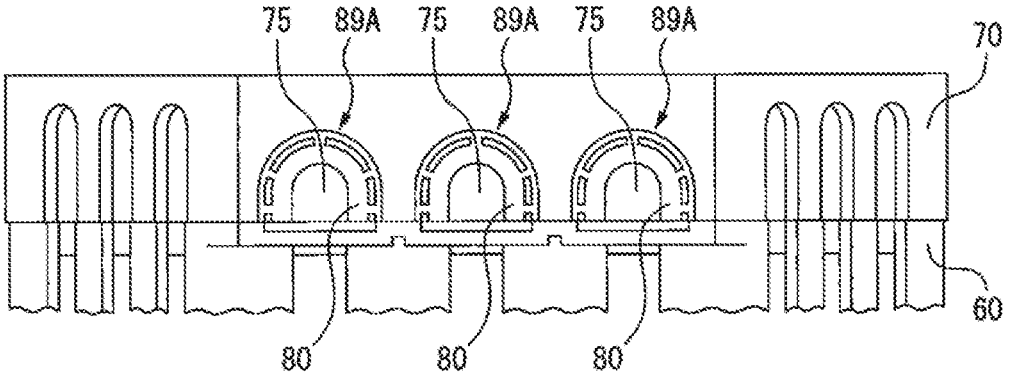
FIG. 3A is an enlarged view of cutouts formed in a cover.

FIG. 3A is an enlarged view of cutouts formed in the cover. As illustrated in FIG. 3A, the cutouts 75, together with the top face of the energizing portion 60, form openings. The cutout 75 may have another shape. Further, at least one adjustment member 80 that adjusts an area of the cutout 75 is at least partially provided on an inner surface of the cutout 75. In FIG. 3A, the adjustment member 80 extends in a circumferential direction of the cutout 75.

Furthermore, in FIG. 3A, the adjustment member 80 and the cover 70 are connected to each other by a perforated portion 89A including at least one perforation and a connection portion adjacent to the perforation. The adjustment members 80 and the perforated portions 89A are preferably integrally formed with the cover 70. A thickness of the connection portion may be smaller than thicknesses of the adjustment member 80 and the cover 70.

Figure 3B:
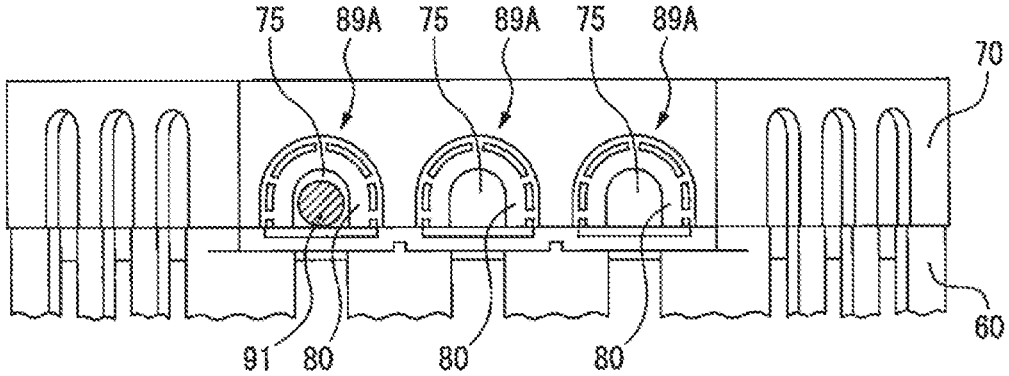
FIG. 3B is a view similar to FIG. 3A with a cable having a small cross-sectional area connected thereto.

FIG. 3B is a view similar to FIG. 3A with a cable having a small cross-sectional area connected thereto. In FIG. 3B, a cable 91 with a small cross-sectional area, for example, a cable that does not conform to NFPA, is inserted into the cutout 75 and is connected to the input side terminal or the output side terminal of the energizing portion 60 by a known method. Because the adjustment member 80 is provided on the inner surface of the cutout 75, there is little clearance between the cable 91 and the inner surface of the cutout 75.

Therefore, even in a case where the cable 91 having a small cross-sectional area is passed through the cutout 75 and is connected to the terminal described above, the finger or the like of the operator is prevented from entering the clearance between the cutoff 75 and the cable and coming into contact with the terminal or the like of the energizing portion 60.

Figure 3C:
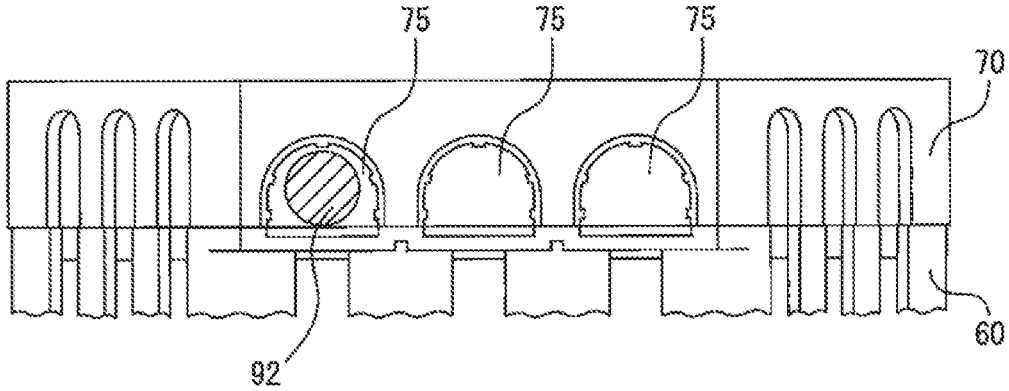
FIG. 3C is a view similar to FIG. 3A with a cable having a large cross-sectional area connected thereto.

However, a cable 92 having a large cross-sectional area, for example, a cable conforming to NFPA, cannot be inserted into the cutout 75 illustrated in FIG. 3A and FIG. 3B. In this regard, FIG. 3C is a view similar to FIG. 3A with a cable having a large cross-sectional area connected thereto. In FIG. 3C, the adjustment member 80 is removed.

As described above, the adjustment member 80 is connected to the cutout 75 by the perforated portion 89A. Because the strength of the perforated portion 89A is smaller than the strength of the cover 70 and the strength of the adjustment member 80, the operator can pinch the adjustment member 80 with the fingers and easily cut the adjustment member 80 away from the cover 70. As a result, the areas of the cutouts 75 illustrated in FIG. 3C are larger than the areas of the cutouts 75 illustrated in FIG. 3A and FIG. 3B. Accordingly, even the cable 92 having the large cross-sectional area can be passed through the cutout 75 and be connected to the terminal of the energizing portion 60. In this case as well, because there is little clearance between the cable 92 and the inner surface of the cutoff 75, the finger or the like of the operator is prevented from entering the clearance between the cutoff 75 and the cable and coming into contact with the terminal or the like of the energizing portion 60.

Thus, in the present disclosure, by cutting away the adjustment member 80 according to diameters of the cables 91 and 92 to be connected, the clearance between each of the cables 91 and 92 and the cutout 75 of the cover 70 can be adjusted so as to be minimum while the cables 91 and 92 are connected to the energizing portion. Therefore, regardless of the diameters of the cables 91 and 92 to be connected to the energizing portion 60, it is possible to prevent the operator from easily contacting the terminal or the like of the energizing portion 60.

Figure 4A:
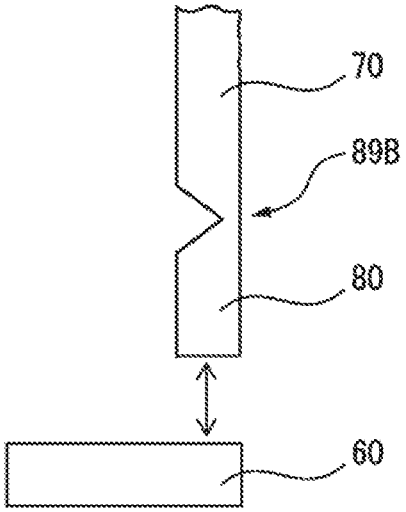
FIG. 4A is a cross-sectional view of a cutout formed in a cover according to another embodiment.

FIG. 4A is a cross-sectional view of a cutout formed in a cover according to another embodiment. In FIG. 4A, the adjustment member 80 and the cover 70 are connected by a thin portion 89B. A thickness of the thin portion 89B is smaller than a thickness of the adjustment member 80 and a thickness of the cover 70. Note that the thickness of the adjustment member 80 and the thickness of the cover 70 are preferably substantially the same, or the thickness of the adjustment member 80 is preferably a thickness between the thickness of the cover 70 and the thickness of the thin portion 89B. Furthermore, as described above, the adjustment member 80 and the thin portion 89B are preferably integrally formed with the cover 70.

Figure 4B:
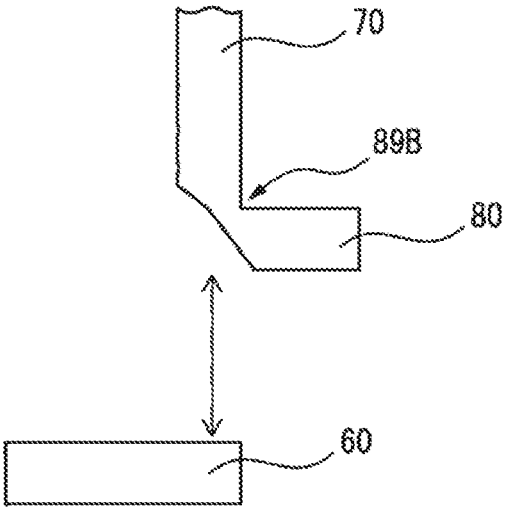
FIG. 4B is another cross-sectional view of the cutout formed in the cover according to the other embodiment.

FIG. 4B is another cross-sectional view of the cutout formed in the cover according to the other embodiment. As can be seen in FIG. 4B, the operator may pinch the adjustment member 80 and may bend the adjustment member 80 from the thin portion 89B by approximately 90 degrees with respect to the cover 70. In this case as well, it will be seen that a similar effect to that described above is obtained. Note that it is preferable to bend the adjustment member 80 toward the outside of the cover 70 in order to further prevent the operator from contacting the terminal or the like of the energizing portion 60.

Figure 5:
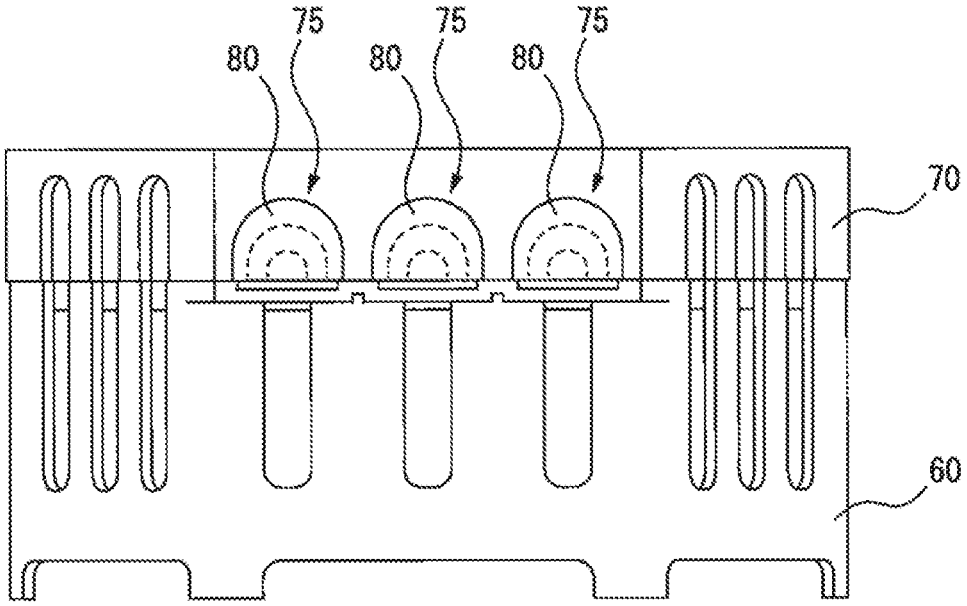
FIG. 5 is an enlarged view of a cover of a reactor according to a second embodiment.

FIG. 5 is an enlarged view of a cover of a reactor according to a second embodiment. The cutouts 75 illustrated in FIG. 5 are completely closed by the adjustment members 80.

Figure 6:
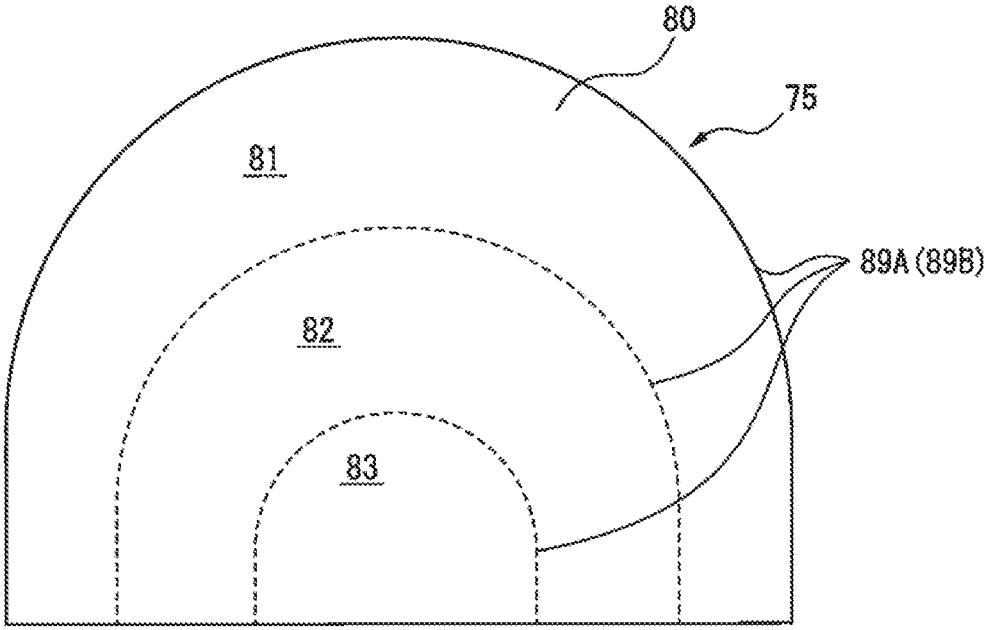
FIG. 6 is an enlarged view of a closing member of the cover illustrated in FIG. 5.

Further, FIG. 6 is an enlarged view of a closing member of the cover illustrated in FIG. 5. In the second embodiment, a plurality of, for example, three adjustment members 81 to 83 are illustrated. Each of the adjustment members 81 to 83 extends in a circumferential direction of the cutout 75, and is sequentially arranged in a radial direction of a cable (not illustrated in FIG. 6) or in a height direction of the cutout 75. However, some adjustment members, such as adjustment members 82 and 83, may be removed from the beginning and the cutout 75 may be only partially closed.

The adjustment member 81 extends in the circumferential direction of the cutout 75 and is connected to the cutout 75 by a perforated portion 89A. Similarly, the adjustment member 82 extends in the circumferential direction of the cutout 75 and is connected to the adjustment member 81 by a perforated portion 89A. Similarly, the adjustment member 83 extends in the circumferential direction of the cutout 75 and is connected to the adjustment member 82 by a perforated portion 89A.

Figure 7A:
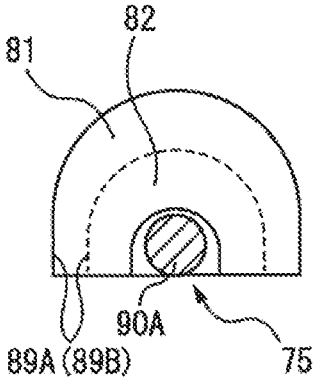
FIG. 7A is a first partially enlarged view of the closing member.
Figure 7B:
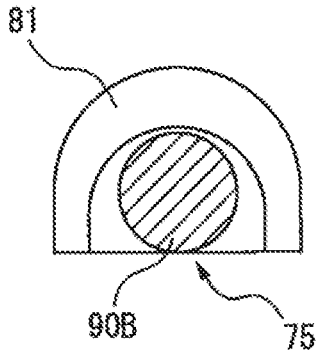
FIG. 7B is a second partially enlarged view of the closing member.
Figure 7C:
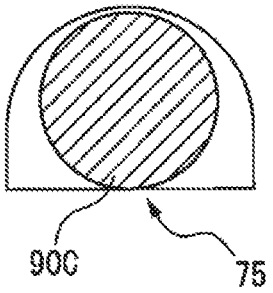
FIG. 7C is a third partially enlarged view of the closing member.

Each of FIG. 7A to FIG. 7C is a partially enlarged view of the closing member. In FIG. 7A, the adjustment member 83 is cut away from the adjustment member 82. Accordingly, a cable 90A having a relatively small diameter can be appropriately inserted into the cutout 75 formed by cutting away the adjustment member 83, and can be connected to the terminal described above. Because there is little clearance between the cable 90A and the cutout 75, the finger or the like of the operator does not enter the clearance between the cutout 75 and the cable 90A, and the operator does not contact the terminal or the like of the energizing portion 60.

In FIG. 7B, the adjustment members 82 and 83 are cut away from the adjustment member 81. Accordingly, a cable 90B having a relatively large diameter can be appropriately inserted into the cutout 75 formed by cutting away the adjustment members 82 and 83, and can be connected to the terminal described above. As described above, because there is little clearance between the cable 90B and the cutout 75, the finger or the like of the operator does not enter the clearance between the cutout 75 and the cable 90B.

In FIG. 7C, all of the adjustment members 81 to 83 are cut away from the cutout 75. Accordingly, a cable 90C (e.g., a cable conforming to the North American standard: NFPA) having a larger diameter can be appropriately inserted into the cutout 75 formed by cutting away the adjustment members 81 to 83, and can be connected to the terminal described above. As described above, because there is little clearance between the cable 90C and the cutout 75, the finger or the like of the operator does not enter the clearance between the cutout 75 and the cable 90C.

Thus, in the second embodiment, by cutting away some or all of the plurality of adjustment members 81 to 83, it is possible to secure the safety of the operator even when various dimensions of cables are inserted. Note that a similar effect can be obtained even when the thin portion 89B is used instead of the perforated portion 89A and at least one of the adjustment members 81 to 83 is bent.

Figure 8:
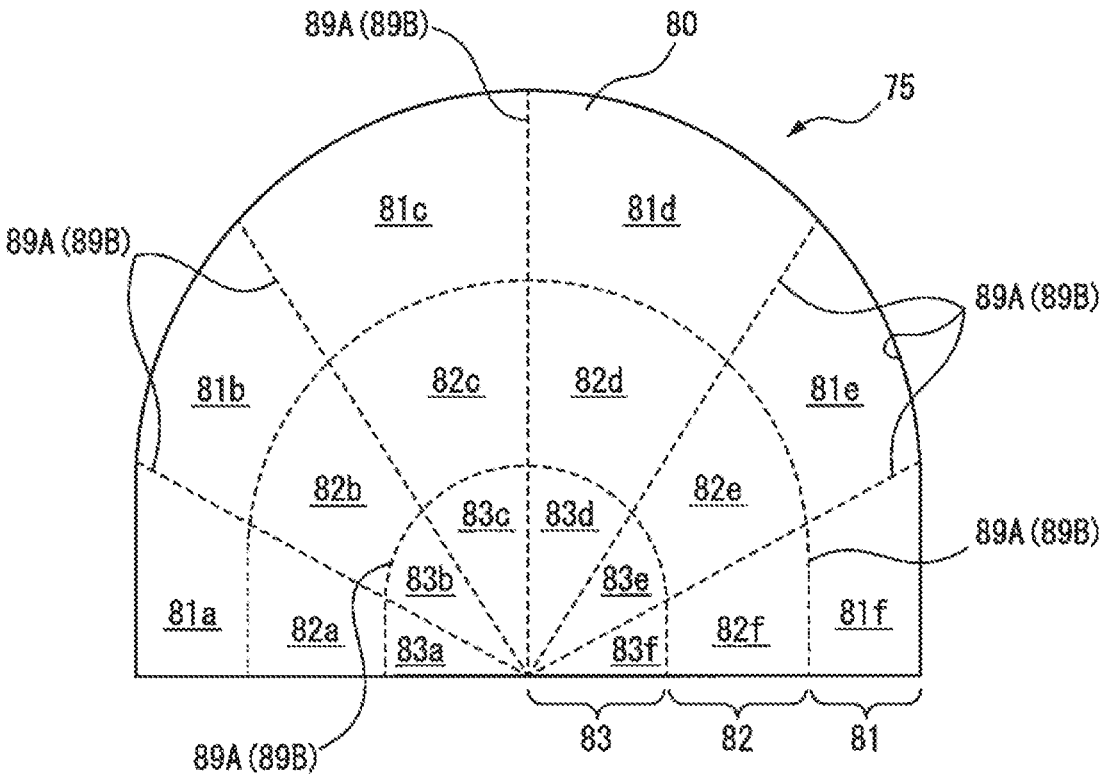
FIG. 8 is an enlarged view of a closing member of a cover in a modified example.

Furthermore, FIG. 8 is an enlarged view of a closing member of a cover according to a modified example. In FIG. 8, the adjustment member 81 is configured with a plurality of small adjustment members 81*a* to 81*f* sequentially arranged in the circumferential direction of the cutout 75. Similarly, the adjustment member 82 is configured with a plurality of small adjustment members 82*a* to 82*f* sequentially arranged in the circumferential direction of the cutout 75, and the adjustment member 83 is configured with a plurality of small adjustment members 83*a* to 83*f* sequentially arranged in the circumferential direction of the cutout 75.

The plurality of small adjustment members 81*a* to 81*f* of the adjustment member 81 are connected to each other by perforated portions 89A or thin portions 89B. The same applies to the plurality of small adjustment members 82*a* to 82*f*, and 83*a* to 83*f* of the other adjustment members 82 and 83.

When a cable having a complex cross section needs to be inserted into the cutout 75, the operator can cut away or bend at least one of the small adjustment members 81*a* to 83*f* in order to cope with such a complex cross section. Therefore, even when a cable has a complex cross section, such a cable can be easily inserted into the cutout 75, and as a result, a similar effect to that described above can be obtained.

Figure 9:
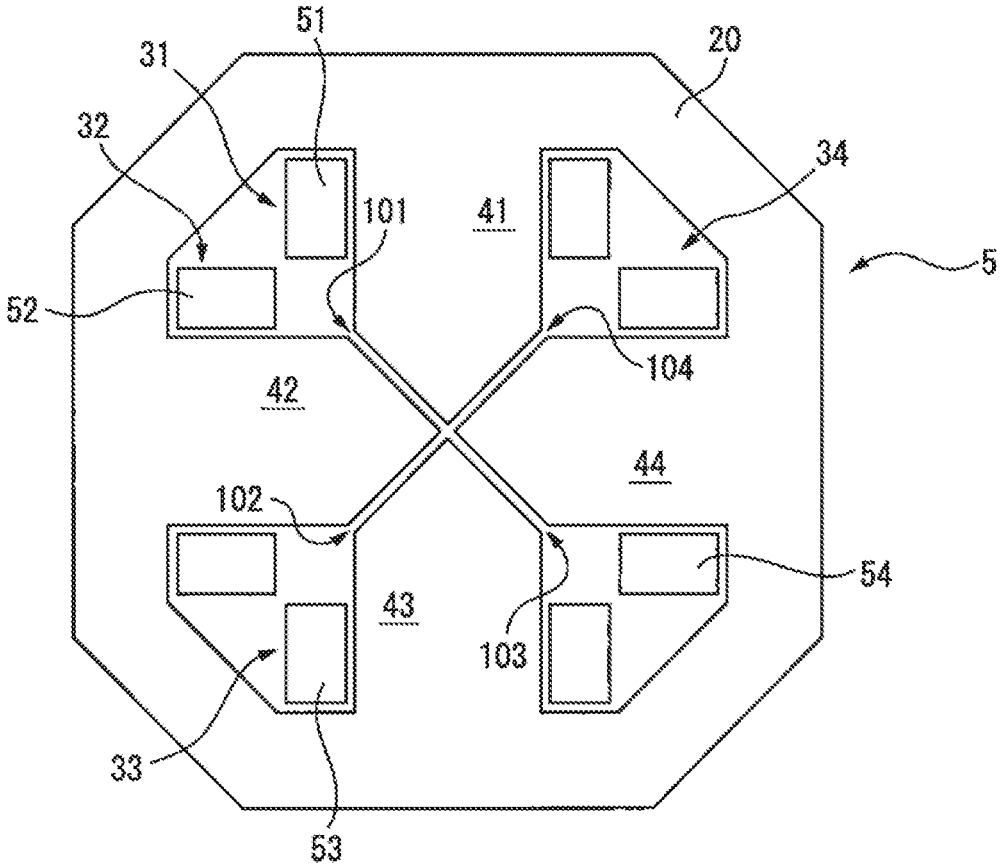
FIG. 9 is a cross-sectional view of a reactor according to still another embodiment.

FIG. 9 is a cross-sectional view of the reactor 5 according to still another embodiment. The reactor 5 illustrated in FIG. 9 includes the outer peripheral iron core 20 having a substantially octagonal shape and four iron core coils 31 to 34 that are similar to those described above, and that are disposed inward the outer peripheral iron core 20. These iron core coils 31 to 34 are arranged at equal intervals in a circumferential direction of the reactor 5. In addition, the number of iron cores is preferably an even number equal to or more than four, and thus the reactor 5 can be used as a single-phase reactor.

It is apparent from the drawing that the iron core coils 31 to 34 respectively include iron cores 41 to 44 extending in a radial direction and coils 51 to 54 wound around the corresponding iron cores. A radially outer end portion of each of the iron cores 41 to 44 contacts the outer peripheral iron core 20, or is formed integrally with the outer peripheral iron core 20.

In addition, a radially inner end portion of each of the iron cores 41 to 44 is positioned near a center of the outer peripheral iron core 20. In FIG. 9, the radially inner end portion of each of the iron cores 41 to 44 converges toward the center of the outer peripheral iron core 20 and has a tip angle of about 90 degrees. The radially inner end portions of the iron cores 41 to 44 are spaced apart from one another via gaps 101 to 104 capable of being magnetically coupled.

The energizing portion 60 having a similar configuration is attached to one end face of the outer peripheral iron core including an even number equal to or more four of iron cores as illustrated in FIG. 9, and the cover 70 having a similar configuration is further attached to the energizing portion 60. Even with such a reactor 5, it is possible to prevent the operator from easily contacting the energizing portion regardless of a diameter of a cable to be connected to the energizing section, because of a similar reason to those described above.

Aspects of the Disclosure

According to a first aspect, a reactor (6) is provided that includes a core body (5), the core body including an outer peripheral iron core (20), at least three iron cores (41 to 44) disposed to contact an inner surface of the outer peripheral iron core or disposed to be coupled to the inner surface, and a coil (51 to 54) wound around the iron core, wherein a gap (101 to 104) capable of being magnetically coupled between one iron core among the at least three iron cores and another iron core adjacent to the one iron core is formed, and that further includes an energizing portion (60) connected to the coils and configured to be connected to a cable, and a cover (70) provided to cover the energizing portion, wherein at least one cutout (75) formed in the cover is provided with at least one adjustment member (80, 81 to 83) configured to adjust an area of the cutout at least partially in the cutout, and the at least one adjustment member is configured to be cut away from the cutout or is configured to be bent with respect to a surface where the cutout is formed.

According to a second aspect, in the first aspect, the at least one adjustment member is integrally formed with the cover, and the at least one adjustment member and the cover are connected by a perforated portion (89A) or a thin portion (89B).

According to a third aspect, in the first aspect, a plurality of the adjustment members sequentially arranged in a radial direction of the cable are provided, and the plurality of the adjustment members are connected to each other by a perforated portion or a thin portion.

According to a fourth aspect, in the first aspect, the at least one adjustment member is configured with a plurality of small adjustment members (81*a* to 81*f*, 82*a* to 82*f*, 83*a* to 83*f*) sequentially arranged in a circumferential direction of the cutout.

According to a fifth aspect, in any one of the first to fourth aspects, the number of the at least three iron cores is a multiple of three.

According to a sixth aspect, in any one of the first to fourth aspects, the number of the at least three iron cores is an even number equal to or more than four.

Effects of Aspects

In the first aspect, by cutting away or bending the adjustment member according to a diameter of a cable to be connected, a clearance between the cable and an opening of the cover can be adjusted so as to be minimized while the cable is connected to the energizing portion. Therefore, regardless of the diameter of the cable to be connected to the energizing portion, it is possible to prevent an operator from easily contacting a terminal or the like of the energizing portion.

In the second aspect, the adjustment member can be easily cut away or bent.

In the third aspect, by cutting away or bending at least one of the plurality of adjustment members, cables of various dimensions can be easily coped with.

In the fourth aspect, a cable having a complex cross section can be easily coped with.

In the fifth aspect, the reactor can be used as a three-phase reactor.

In the sixth aspect, the reactor can be used as a single-phase reactor.

While the invention has been described with reference to specific embodiments, it will be understood, by those skilled in the art, that various changes or modifications may be made thereto without departing from the scope of the claims described later.

The invention claimed is:

1. A reactor comprising:

a core body, the core body including an outer peripheral iron core, at least three iron cores disposed to contact an inner surface of the outer peripheral iron core or disposed to be coupled to the inner surface, and a coil wound around the iron core, wherein a gap capable of being magnetically coupled between one iron core among the at least three iron cores and another iron core adjacent to the one iron core is formed, the reactor further comprising:

an energizing portion connected to the coils and configured to be connected to a cable; and a cover provided to cover the energizing portion, wherein at least one cutout is formed on a side surface of the cover, at least one adjustment member is provided on the side surface of the cover, extends in a circumferential direction of the cutout and adjusts an area of the cutout, and the at least one adjustment member is configured to be cut away from the cutout, or is configured to be bent with respect to a surface where the cutout is formed.

2. The reactor of claim 1, wherein the at least one adjustment member is integrally formed with the cover, and the at least one adjustment member and the cover are connected by a thin portion or a perforated portion.

3. The reactor of claim 1, wherein the at least one adjustment member includes a plurality of adjustment members sequentially arranged in a radial direction of the cable are provided, and the plurality of the adjustment members are connected to each other by a perforated portion or a thin portion.

4. The reactor of claim 1, wherein the at least one adjustment member is configured with a plurality of small adjustment members sequentially arranged in a circumferential direction of the cutout.

5. The reactor of claim 1, wherein the number of the at least three iron cores is a multiple of three.

6. The reactor of claim 1, wherein the number of the at least three iron cores is an even number equal to or more than four.

* * * * *